United States Patent [19]

DelPercio

[11] 4,337,823

[45] Jul. 6, 1982

[54] ELECTRIC FURNACE FOR MOBILE AND MODULAR HOMES

[75] Inventor: Michael J. DelPercio, St. Louis County, Mo.

[73] Assignee: Intertherm Inc., St. Louis, Mo.

[21] Appl. No.: 82,005

[22] Filed: Oct. 5, 1979

[51] Int. Cl.[3] ..... F25B 29/00; F28F 7/00

[52] U.S. Cl. ..... 165/48 R; 165/53; 165/65; 165/76; 165/122; 219/361; 219/366; 219/371; 165/137

[58] Field of Search ..... 165/42, 48, 53, 58, 165/61, 62, 65, 76, 122, 137; 219/359, 361, 369, 370, 366

[56] References Cited

U.S. PATENT DOCUMENTS

| | | | |
|---|---|---|---|
| 2,773,676 | 12/1956 | Boyle et al. | 165/48 |
| 3,583,175 | 6/1971 | Eubank | 165/48 |
| 3,653,431 | 4/1972 | Loveley | 165/53 |
| 3,685,577 | 8/1972 | Goodgion et al. | 165/48 |
| 3,749,157 | 7/1973 | Davison | 165/48 |
| 4,035,610 | 7/1977 | Roth | 165/122 |

*Primary Examiner*—Albert W. Davis
*Assistant Examiner*—Margaret A. Focarino
*Attorney, Agent, or Firm*—Jerome A. Gross

[57] ABSTRACT

A rectangular enclosed electric furnace cabinet, for mobile and modular homes, has a downward blower which draws air downward from an upper wall duct inlet over electric resistance heaters and out through a lower wall duct outlet to the underfloor ducts of the home. A rectangular open frame member, mounting a louvered door, is secured to the cabinet upper wall at its forward end. After closet installation of the cabinet, final wall trim, adjacent to the cabinet sides and the open frame member, may be added. In use exclusively as an electric furnace, a furnace filter is secured beneath the upper furnace inlet by a pair of diagonally-crossed elongated clips. The cabinet is adaptable for use as the indoor unit of a central air conditioner or heat pump by the addition of an A-coil over the upper air inlet; then filters are provided instead on the upper sloping sides of the coil and the elongated clips are utilized to secure insulation sheet to the interior of the cabinet.

3 Claims, 7 Drawing Figures

ELECTRIC FURNACE FOR MOBILE AND MODULAR HOMES

BACKGROUND OF THE INVENTION

The present invention relates generally to downflow type furnaces, specifically of the type for installation in mobile and modular homes, and particularly of the type having an associated air conditioner or heat pump.

Electric furnaces for use in mobile homes or in modular homes are generally of the downflow type mounted in a narrow closet provided for that purpose and include electric heating elements, a blower, and a filter. The filter is mounted vertically behind the upper air inlet at the front of the cabinet or slided in horizontally above the blower. Space is sometimes provided within the cabinet for a refrigeration coil for an air conditioner or heat pump by making the cabinet taller than would otherwise be necessary; in such case louvers in the cabinet forward wall may fail to provide uniform air flow to the entire coil surface. If not so provided, the furnace cabinet may be elevated and the coil mounted in an added enclosure beneath the furnace cabinet.

SUMMARY OF THE INVENTION

The primary object of the present invention is to provide a compact electric furnace cabinet for closet installation in mobile and modular homes, which may be conveniently utilized with an air conditioning or heat pump system without additional cabinetry.

Briefly summarizing, the present furnace includes a short cabinet having a front access door, a lower duct outlet in the cabinet bottom, electric resistance heaters immediately above the outlet, and a downward blower supported above the heater in an intermediate horizontal wall. The upper wall of the cabinet, above the blower, has an upwardly-flanged horizontal air inlet; a furnace filter may be slided in horizontally above the blower beneath the inlet, and held in place by a pair of elongated horizontal clips. A rectangular open frame is mounted on the cabinet upper wall as its forward end; it accepts a front panel grille used as the air inlet. After securing the furnace cabinet in the closet and mounting the upper open frame, final framing and trim may be added to the closet.

Where the home is to be cooled by a central air conditioner or heated and cooled by a heat pump, an inverter V-shaped refrigeration coil, usually called an A-coil, is mounted on the cabinet upper wall over the air inlet, enclosed only by the closet. The coil is enclosed at its sides by a pair of inverted V-shaped vertical panels and accepts a filter assembly held down on its two upper sloping sides, substituted for the furnace filter adjacent to the cabinet top wall. Air which leaks into the closet, as well as that entering via the front panel grille, is filtered before being drawn downward through the coil. The large space in the closet in which the A-coil is mounted provides nearly uniform airflow over the coil, for maximum utilization of its capacity.

If no refrigeration coil is to be employed, insulation of the cabinet walls above the heating coils would serve no purpose. In the present invention, the cabinet is insulated at the time air conditioning is installed, and after removing the furnace filter, utilizing the elongated clip vertically to now hold the insulation in place against the cabinet walls.

DESCRIPTION OF THE PREFERRED EMBODIMENT

Figure 1:
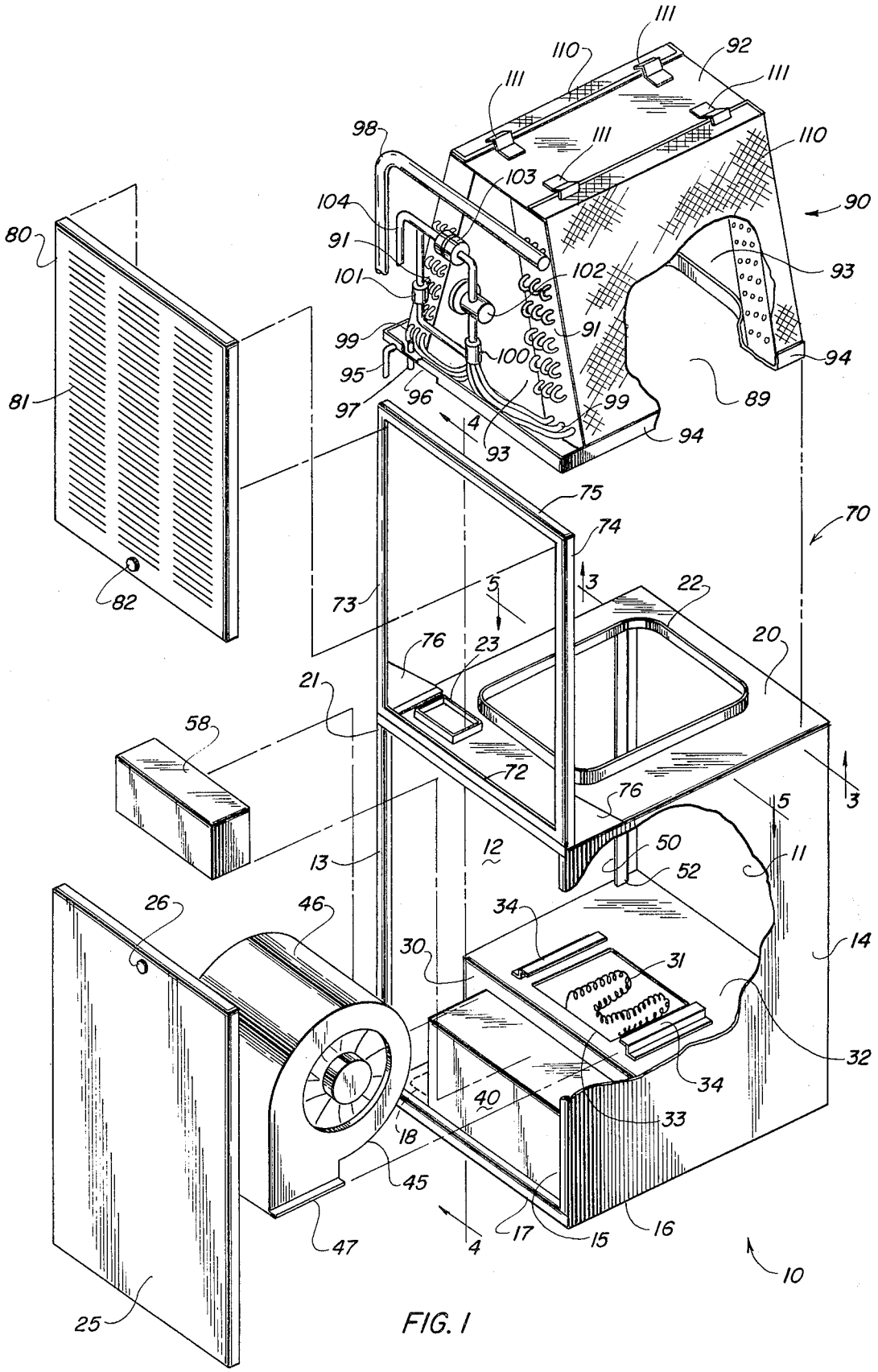
FIG. 1 is an exploded oblique projection showing a preferred embodiment of the present invention, an improved electric furnace cabinet for mobile and modular homes.

Described in detail, the preferred embodiment of the present invention, shown in an exploded oblique view in FIG. 1, is comprised of an enclosed upright rectangular furnace cabinet, generally designated 10, having a rear wall 11, a left side wall 12 extending forward from the rear wall 11 to an inward-extending reverse flange 13, and a right side wall 14 similarly extending forward from the rear wall 11 to an inward-extending reverse flange 15. The lower end of the cabinet 10 is enclosed by a bottom wall 16 having a reverse flange 17 at its forward end, a lower air outlet duct opening (not shown) and, at its left foremost corner, a piping knockout 18 through which refrigerant lines may be passed. The cabinet 10 has a top wall 20 with a similar reverse flange 21 at its forward edge, an upwardly-flanged upper duct opening 22, and an upwardly-flanged piping passage 23 in its left forward corner, generally vertically aligned with the piping knockout 18 of the bottom wall 16.

A removable door 25 encloses the cabinet 10 at its forward side. The door is provided with handle-manipulated catch 26 which engages the reverse flange 21 of the top wall 20.

A rectangular heating element enclosure 30 is presented over the bottom wall lower air outlet duct at the rear two-thirds of the cabinet, enclosing heating elements 31 beneath its upper wall 32, which serves as an intermediate support. The upper wall 32 has a rectangular blower opening 33 flanked by a pair of fore-to-aft blower slide mounts 34. Forward of the heating element enclosure 30 a control box 40 on the bottom wall 16 extends from the right side of the piping knockout 18 to the right side wall 14, leaving a space at the left side of the control box 40 through which the refrigerant lines may pass. The control box 40, which contains electrical wiring for the blower and heating elements 31, extends upward short of the height of the heating element enclosure 30.

A scroll-type electric motor-driven downward blower 45, mounted to the upper wall 32 of the heating element enclosure 30, has a curved blower housing 46 and outward-extending side flanges 47 which engage the blower slide-mounts 34. The forward side of the curved blower housing 46 extends downward to a level beneath that of the side flanges 47, abutting the forward side wall of the heating element enclosure 30 on mounting of the blower 45, while the aft side of the housing 46 ends immediately forward of the cabinet rear wall 11.

A pair of vertically-mounted Z-flanges 50 are provided, one spot-welded by an end flange to the rear edge of each of the left and right side walls 12, 14; they extend inward and finally forward, each thus defining an inward-extending wall 51 spaced from the rear wall 11 and a forward-extending wall 52 spaced from the side wall 12, 14. Each Z-flange 50 has a pair of bores just beneath the cabinet top wall 20, one in its inward-extending wall 51 and another in its forward-extending wall 52. Likewise, the reverse flanges 13, 15 of the side walls 12, 14 each have a pair of bores in their rearward-extending portion, one immediately above the level of the heating element enclosure upper wall 32 and another beneath the cabinet top wall 20.

Figure 2:
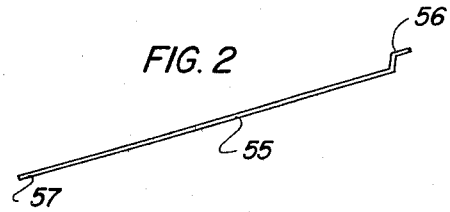
FIG. 2 shows an elongated clip utilized in the preferred embodiment for installing either insulation sheet or a furnace filter.

An elongated clip 55, shown in FIG. 2, is accepted by the bores in the Z-flanges 50 and side wall reverse flanges 13, 15. A pair of these clips 55 are utilized to mount a furnace filter a beneath the top wall 20 of the cabinet 10, for use of the present invention as an electric furnace only; or where the cabinet is to serve as an indoor unit for a central air conditioner or heat pump, the elongated clips 55 are instead utilized to secure insulation sheets b to the inner side of the side walls 12, 14. Each elongated clip 55 is fashioned of a straight length of small diameter steel rod and has a straight end portion 57 and an offset end portion 56, formed by a pair of spaced-apart right-angle bends such that a short length of the rod continues parallel but offset from the major length of the rod.

Where the cabinet is to be utilized as an indoor unit for a heat pump or air conditioner, in the preferred embodiment a relay box 58 is mounted on the upper side of the control box 40 forward of the blower 45, enclosing relays required for the refrigeration system.

The present invention further includes an upper air inlet assembly, generally designated 70, vertically mounted at the forward edge of the cabinet top wall 20, and made up of a rectangular frame 71 formed of a lower angle 72, left and right side angles 73, 74 and a top angle 75. Inwardly-flanged aft-extending gusset supports 76 secure the right and left side angles 73, 74 of the rectangular frame 71 to the cabinet top wall 20. A door 80, having a louvered opening 81, is removably mounted to the forward side of the rectangular frame 71, secured by a handle-manipulated catch 82.

For utilization as a heat pump or air conditioning indoor unit, the preferred embodiment of the present invention is provided with an A-shaped refrigeration coil, generally designated 90, of the type commonly known as an A-coil, made up of two flat refrigerant coils 91 secured in an inverted V position by a top plate 92 and a pair of inverted V-shaped side plates 93. The lower ends of the two coils 91 rest in a rectangular frame-like condensate pan 94 having a rectangular upwardly-flanged center opening 89 which may be accepted by the upwardly-flanged upper duct opening 22 of the cabinet top wall 20. A primary drain tube 95 extends from the side wall of the condensate pan 94 downward, to pass through the top wall piping passage 23, the bottom wall piping knockout 18 in the cabinet 10 and a suitable opening in the floor of the closet in which the cabinet 10 is installed. The lower wall of the condensate pan 94 has a raised portion 96; a vertical overflow drain tube 97 extends from a bore in the raised portion upward to immediately above the level of the primary drain tube 95. Accordingly, should the primary drain tube be clogged, water accumulating in the condensate pan may flow out through the overflow drain tube 97 and pass beneath the pan raised position 96 to escape over the furnace top wall 20 outward to its outer sides.

Other conventional refrigeration hardward mounted to the coil 90 includes a suction line header 98 coupling the upper ends of the two refrigeration coils 91 and extending downward therefrom. The lower ends of the two coils 91 are coupled by distribution tubes 99 to a distributor 100; two lines extending from the distributor 100 connect to a check valve 101 and an expansion valve 102. The expansion valve connects to a filter-drier 103, which, with the check valve 101, connects to the liquid line 104. The suction line 98 and liquid line 104 pass downward through the top wall piping passage 23, the bottom wall piping knockout 18, and an opening in the closet floor, from which they lead to the outdoor unit.

When the A-coil 90 is attached to the cabinet top wall 20, coil filters 110, preferably of the weaved aluminum mat type, are mounted to the upper sloping sides of each refrigerant coil 91. The lower end of each filter 110 is secured between one of the coils 91 and the outer wall of the condensate pan 94, while its upper edge is clamped by spring-like clips 111 on the top plate 92. Alternatively, clips may be provided at the sides of the coils 91.

In use of the present furnace cabinet exclusively as an electric furnace, and not as the indoor unit of a central air conditioner or a heat pump, the cabinet 10 with the blower 45 installed is mounted into a cabinet enclosure in a mobile or modular home over the entrance to ducting beneath the floor. A conventional-type base mounting plate (not shown) may be utilized. The cabinet enclosure may be merely an unfinished closed space of such size as to receive the cabinet 10 with the front edge of its doors 25, 80 substantially flush with the wall in which it is mounted. With the cabinet 10 in the closet space with the upper air inlet assembly 70 mounted to its top wall 20, final wall trim may be installed adjacent to the left and right sides 12, 14 of the cabinet 10 and the left side, right side, and top angles 73, 74, 75 of the rectangular frame 71. Upon securing the doors 25, 80 in place, a finished wall is provided, but removal of the lower cabinet door 25 affords access to the furnace filter, controls, blower 45, and heating elements 31, while removal of the upper door 80 permits later installation of a refrigeration coil for retrofit as an indoor unit for a central air conditioner or heat pump.

Figure 3:
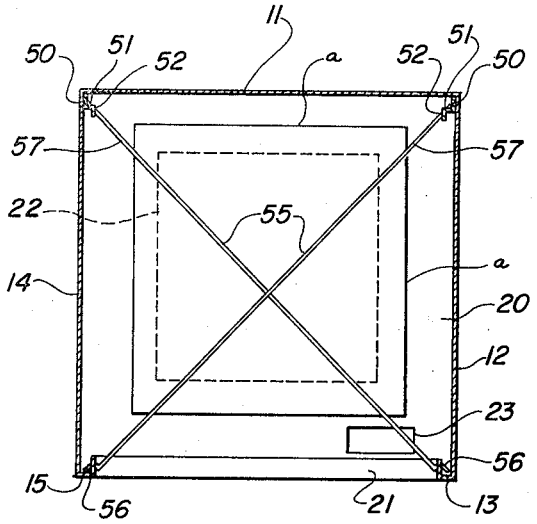
FIG. 3 is a sectional view, taken along line 3—3 of FIG. 1, with the door removed, showing the mounting of a furnace filter utilizing two such elongated clips, when the installation is for electric heating only.
Figure 6:
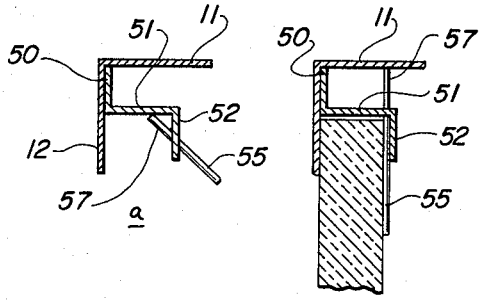
FIG. 6 is an enlarged detail of the engagement of an elongated clip with a rear Z-flange, FIG. 6*a* showing the position for mounting a furnace filter and FIG. 6*b* showing the alternate position for securing sheet insulation.
Figure 7:
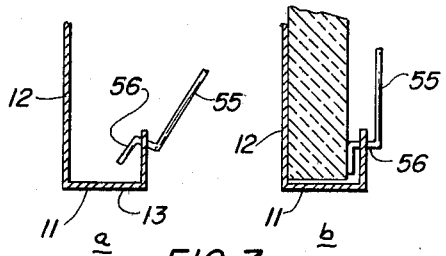
FIG. 7 is a similar detail of the engagement of an elongated clip with the front side wall reverse flange, FIG. 7*a* showing the position for mounting a furnace filter and FIG. 7*b* showing the alternate position for securing sheet insulation.

For use as a furnace only, a furnace filter a is mounted beneath the cabinet top wall 20, as shown in FIG. 3, secured in place beneath the upper duct opening 22 of the top wall 20 by the diagonal placement of a pair of the elongated clips 55. Each clip 55 is mounted by its offset end portion 56 through a bore in a side wall reverse flange 13, 15 just beneath the top wall 20, as shown in FIG. 7*a*, and extends diagonally in a substantially horizontal plane to a bore in the forward-extending wall 52 of the Z-flange 50 on the opposite side of the cabinet 10, as shown in FIG. 6*a*. The clip 55 is easily mounted in these positions by slightly bowing it until its opposite ends engage the bores. The furnace filter a may be removed and replaced without removal of the clips 55, or the clips 55 may be removed for replacement of the filter a.

Alternatively, fur use as the indoor unit for a heat pump or central air conditioner, the cabinet is similarly mounted in a cabinet enclosure with the wall trim installed adjacent the sides and top of the cabinet 10 and upper air inlet assembly 70. The A-coil 90 is mounted to the cabinet top wall 20 over the upper duct opening 22 with its suction line 98, liquid line 104 and primary drain tube 95 extending downward through the piping passage 23 and piping knockout 18. The vertical drain tube 97 in the raised portion 96 of the pan 94 drains the condensate onto the top wall 20 of the cabinet 10, if the primary drain tube 95 should be clogged. The optional relay box 58 is added, mounted on top of the control box 40. In this use, the aluminum coil filters 110 on the sloping upper sides of the A-coil 90 filter both the air which enters through the louvered air inlet of the upper door and the air which leaks behind it. The furnace filter a beneath the cabinet top wall 20 is then not necessary, and if previously installed is removed.

Figure 5:
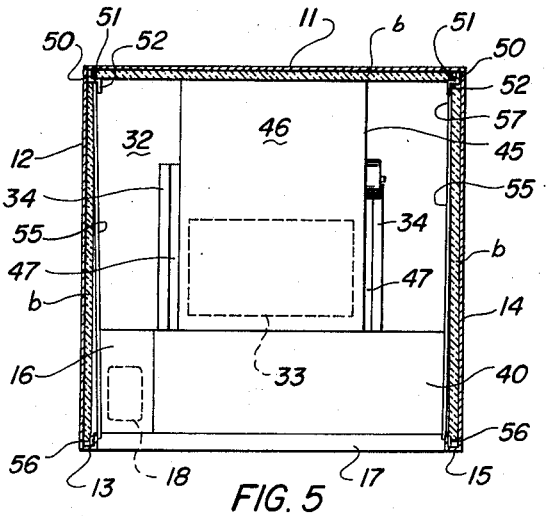
FIG. 5 is a top sectional view, taken along line 5—5 of FIG. 1, with the door removed, showing insulation sheet secured to such side walls and at the rear side of the blower housing.

Since in this use the air in the interior of the furnace cabinet 10 above the heating element enclosure 30 may be cooled by the refrigeration coils 91 (or heated by them, when a heat pump installation operates in the heating mode), insulation sheet b is installed at its left and right side walls 12, 14 and rear wall 11. The insulation may be added in the field, or where the units are sold specifically for use with the A-coil 90, the insulation may be factory installed. With the blower 45 removed, a sheet b of insulation is positioned along the cabinet rear wall 11, with its side edges engaged behind the inward-extending wall 51 of the Z-flanged 50. When the blower 45 is slided into place, the aft side of its curved housing 46 presses on the central portion of the insulated sheet b, assuring it will remain in place, as shown in FIG. 5.

Figure 4:
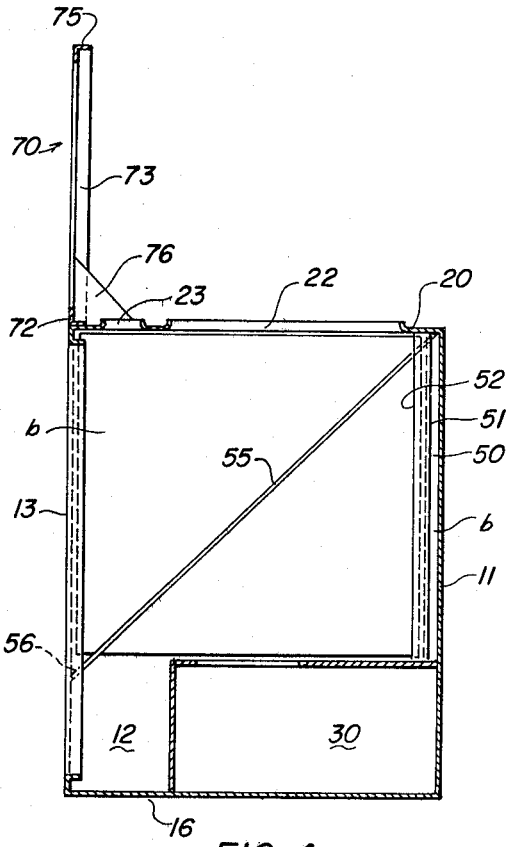
FIG. 4 is a side sectional view, taken along line 4—4 of FIG. 1, with the doors removed, showing in phantom lines an indoor coil for air conditioning, with sheet insulation installed and secured by such an elongated clip to an interior side wall of the furnace, similar insulation being installed on its rear wall.

Insulated sheet b is also mounted along the left and right side walls 12, 14 extending from between the side wall 12, 14 and reverse flange 13, 15 at the forward edge of the cabinet to between the cabinet side wall 12, 14 and the forward-extending wall 52 of the Z-flange 50. For further support, the elongated clips 55, not required for filter mounting in this use, are extended diagonally in a vertical plane between the reverse channels 13, 15 and Z-flanges 50, one at each side of the cabinet. The clip straight end portion 57 extends through a bore in the inward-extending wall 51 at the upper end of the Z-flange 50, as shown in FIG. 6*b*, while the opposite offset end portion 56 extends through the bore in the aft-extending portion of the reverse flange 13, 15 immediately above the heating element enclosure 30, as shown in FIG. 7*b*. A single diagonally-extending clip, so secured at each of its ends, is sufficient to retain the insulation sheet b in place, as shown in FIG. 4.

As will now be clear, a unit previously installed in a mobile or modular home as an electric furnace may later be retrofitted for use as a heat pump or air conditining indoor unit. Since the same clips 55 are utilized for mounting the furnace filter a or the insulation sheet b, there is no likelihood that they will be lost prior to retrofit of the system. Similarly, units prepared by the factory as electric furnaces may be modified for use as the heat pump or air conditioning indoor unit by the installer of the unit, by removal of the furnace filter a and installation of the A-coil 90, relay box 58 and insulation sheet b.

It will be seen that in either of these uses the upper air inlet assembly dually serves as a return air inlet and upper furnace access door, while the closet space it closes off serves in lieu of upper furnace cabinet structure, mounting the coil assembly openly. Using only the short cabinet (as otherwise would be required if no refrigerant coil was installed) the open mounting of the coil within the closet space achieves more even air flow through it than if enclosed in a taller minimum-height cabinet with a front louvered opening only. Hence, the present invention achieves the excellent return air flow which might be afforded by the largest possible cabinet, while reducing the quantity of sheet metal required and providing a "universal" cabinet, for use with or without a refrigerant coil.

Modifications of the preferred embodiment will be obvious from the above disclosure. For example, any type of air-conducting inlet means removably secured to the upper rectangular frame may be utilized. Any type filter means mounted closely adjacent to the upper outer sides of the A-shaped coil may be utilized, and any hold-down means may be used to mount the filter. Furthermore, in use as an electric furnace, any means to mount a furnace filter removably adjacent to the upper duct opening may be utilized. In securing the side edges of the insulation sheet to the inner cabinet side and rear walls, any vertical inward-extending member, which may be angularly flanged, may be affixed at the vertical corners of the inner sides of the cabinet. From these examples, other modifications will suggest themselves.

I claim:

1. A down-flow type furnace of doorless closet installation in mobile or modular homes and the like, comprising an enclosed upright rectangular heater-blower cabinet having a lower air outlet duct opening in the cabinet bottom wall, an electric heating element, a blower, an air inlet opening in the cabinet top wall, forward cabinet door means to provide access to said heating element and blower, and an air inlet assembly including a rectangular frame member substantially vertically mounted, along its lower edge only, onto the forward edge of the top wall of the heater-blower cabinet, the other edges of said frame member being free, whereby said other edges of said frame member may on installation be connected to the final wall trim of such doorless closet, said frame member having an opening commencing above and adjacent to said cabinet top wall, the opening width being substantially the entire width of said cabinet, and an air conducting panel removably secured across said frame member opening; in combination with a refrigeration coil assembly positioned on the cabinet top wall over its said air inlet opening at substantially the level of said frame member opening and mountable therethrough, whereby the height of the furnace cabinet and height of installation are minimized while removal of said air conducting panel affords optimum access for servicing said refrigeration coil assembly, whether of a heat pump or an air conditioner.

2. For optional subsequent utilization of a heat pump or air conditioner, a down-flow type furnace for doorless closet installation in mobile or modular homes and the like, comprising an enclosed upright rectangular heater-blower cabinet having a lower air outlet duct opening in the cabinet bottom wall, an electric heating element, a blower, an air inlet opening in the cabinet top wall, forward cabinet door means to provide access to said heating elements and blower, and an air inlet assembly including a rectangular frame member having three free edges, whereby said edges may on installation be connected to the final wall trim of such doorless closet, said frame member having an opening commencing above and adjacent to said cabinet top wall, the opening width being substantially the entire width of said cabinet, and an air conducting panel removably secured across said frame member opening;

whereby the height of the furnace cabinet and height of its installation are minimized while removal of said air conducting panel affords optimum access through said frame member opening for installing on the cabinet top wall, and servicing a refrigeration coil assembly of such a heat pump or air conditioner.

3. The method of installing an electric furnace in a mobile home or the like, for subsequent utilization of a refrigerant coil, comprising the steps of installing in a doorless closet space upon a floor duct plenum, a down-flow heater-blower cabinet having a top wall air inlet, and constructing a forward closet wall immediately above the edge of the top wall of the heater-blower cabinet and finishing same to the top and side edges of a frame commencing about the level of such top wall and extending upward, the frame having an air conducting panel; and thereafter removing such air conducting panel and positioning through such frame, on the top wall of the heater-blower cabinet about its air inlet, an uncased refrigerant coil and operatively connecting same to an outdoor coil and to the electric furnace, whereby, on adding the uncased refrigerant coil, return air may flow through the air conducting panel to and through the coil and thence through the heating elements of the electric furnace.

* * * * *

UNITED STATES PATENT AND TRADEMARK OFFICE

CERTIFICATE OF CORRECTION

PATENT NO. : 4,337,823

DATED : July 6, 1982

INVENTOR(S) : Michael J. DelPercio

It is certified that error appears in the above—identified patent and that said Letters Patent is hereby corrected as shown below:

In column 1, line 43, delete "as" and substitute ---at---;

In column 1, line 49, delete "inverter" and substitute ---inverted---;

In column 4, line 20, delete "hardward" and substitute ---hardware---;

In column 5, line 13, delete "fur" and substitute ---for---;

In column 5, line 21, after "vertical" insert ---overflow---;

In column 5, line 43, delete "flanged" and substitute ---flange---;

In column 5, line 46, delete "insulated" and substitute ---insulation---;

In column 5, line 48, delete "insulated" and substitute ---insulation---;

In column 6, line 11, after "air" insert ---wall---;

In column 6, line 42, delete "of" and substitute ---for---.

Signed and Sealed this

*Seventh* Day of *September 1982*

[SEAL]

*Attest:*

GERALD J. MOSSINGHOFF

*Attesting Officer*

*Commissioner of Patents and Trademarks*